United States Patent [19]

Focke et al.

[11] Patent Number: 4,488,632

[45] Date of Patent: Dec. 18, 1984

[54] CIGARETTE GROUPING APPARATUS WITH YIELDABLE STOP MEMBER

[75] Inventors: Heinz Focke, Verden; Hugo Mutschall, Kirchlinteln, both of Fed. Rep. of Germany

[73] Assignee: Focke & Co., Verden, Fed. Rep. of Germany

[21] Appl. No.: 361,155

[22] Filed: Mar. 23, 1982

[30] Foreign Application Priority Data

Apr. 23, 1981 [DE] Fed. Rep. of Germany ..... 3116156

[51] Int. Cl.[3] ..... B65G 47/26

[52] U.S. Cl. ..... 198/420; 198/634; 198/856; 131/282; 53/149

[58] Field of Search ..... 198/634, 420, 502, 856; 53/148–151; 131/282, 283; 221/94, 21, 2, 251; 414/89

[56] References Cited

U.S. PATENT DOCUMENTS 3,687,267 8/1972 DeWitt et al. ..... 198/856 X 4,096,682 6/1978 Sheahan ..... 53/151 X

*Primary Examiner*—Joseph E. Valenza

*Assistant Examiner*—Dennis Williamson

*Attorney, Agent, or Firm*—Sughrue, Mion, Zinn, Macpeak and Seas

[57] ABSTRACT

A reciprocable pusher 18 ejects cigarette pack groups 17 from magazine shafts 12 in three stacked layers, with one cigarette 11*a* in the middle layer being retained in the magazine by a stop 24 having an end 25 extending across and blocking the ejection path of the cigarette. The stop comprises a pivotably mounted lever spring biased to enable the expulsion of the cigarette when a predetermined mechanical load is exceeded, to thereby prevent jamming and blockage due to non-uniform cigarettes and stacks.

4 Claims, 6 Drawing Figures

CIGARETTE GROUPING APPARATUS WITH YIELDABLE STOP MEMBER

BACKGROUND OF THE INVENTION

The invention relates to an apparatus for forming groups of cigarettes by pushing them out in several layers on top of one another from vertical magazine shafts, a gap being formed within the group by retaining an individual cigarette against a stop during the pushing-out movement.

In the packaging of cigarettes, it is frequently or predominantly the practice to work with a cigarette magazine as an intermediate container for a relatively large number of cigarettes aligned in the same direction, but not yet grouped. The approximately funnel-shaped magazine is equipped, in the lower region, with a plurality of cigarette shafts which are limited by thin walls such that a self-contained vertical row of individual cigarettes is accommodated in each shaft. In the lower region of each of the shafts formed immediately next to one another, cigarettes are pushed out in groups, such that a group extracted in this way from the cigarette magazine corresponds in number and formation to the of the cigarette pack to be produced. Pushing-out devices are used to push out the groups of cigarettes, and are equipped with a plurality of tongues each penetrating into a cigarette shaft.

To guarantee a formation of the cigarette group which corresponds to that of the particular pack to be produced, it is necessary to retain individual (or even several) cigarettes in a shaft during the pushing-out of the group. This problem arises especially in the production of conventional cigarette packs with a formation arranged in three rows with different numbers of cigarettes. Here, the middle row conventionally has a smaller number of cigarettes than the outer rows and is shifted transversely so that a "saddle arrangement" is obtained. In the case of this widely used relative disposition of the cigarettes within a pack, when the group is pushed out a lateral cigarette must be retained in the middle layer in the appropriate shaft. For this purpose, it is known to arrange on a shaft wall a nose which projects into the shaft region and which retains an individual cigarette.

The above known design of a cigarette magazine or of the cigarette shafts has, however, many disadvantages. The cigarettes sometimes do not lie in the exact relative arrangement required within the respective cigarette shafts. The result of this is that possibly two cigarettes are retained by the projecting nose. Since one of these is to be pushed out, that is to say is loaded by a tongue of the pushing-out device, considerable constraints arise, and frequently deformations of material which result in lengthy disturbances in the packaging process.

SUMMARY OF THE INVENTION

The object on which the invention is based is, while avoiding the disadvantages of known appliances, to provide measures by means of which the considerable machine interruptions, or even greater damage, are prevented when cigarettes or the like are pushed out in different numbers in individual rows.

To achieve this object, the apparatus according to the invention is characterised in that, when a predetermined load is exceeded, the stop can be moved out of the path of movement of the cigarettes.

Accordingly, if, in the apparatus according to the invention, the stop is loaded unduly because of an incorrect relative position of the cigarettes in the cigarette shaft equipped with the stop, the latter moves aside and opens the path of movement to the cigarettes. The group can be ejected completely as a result, though with at least one faulty cigarette. This can be separated out elsewhere in a known conventional way.

According to a further proposal, this movement of the stop as a result of overloading is associated with the generation of a control signal which causes a visual or acoustic alarm and/or stoppage of the machine. Consequently, in this case of a malfunction, appropriate measures can be taken immediately.

According to the invention, the stop is designed as a pivotable lever which is stressed by a restoring spring and one end of which projects into the path of movement of the cigarettes. As a result, a relatively stable and permanently durable retaining means is provided for the individual cigarettes.

Further features of the invention relate to the arrangement and design of the stop and to an adapted form of the cigarette magazine and of the pushing-out device.

BRIEF DESCRIPTION OF THE DRAWINGS

An exemplary embodiment of the invention is explained in more detail below with reference to the drawings in which.

DETAILED DESCRIPTION OF THE PREFERRED EMBODIMENT

Figure 1:
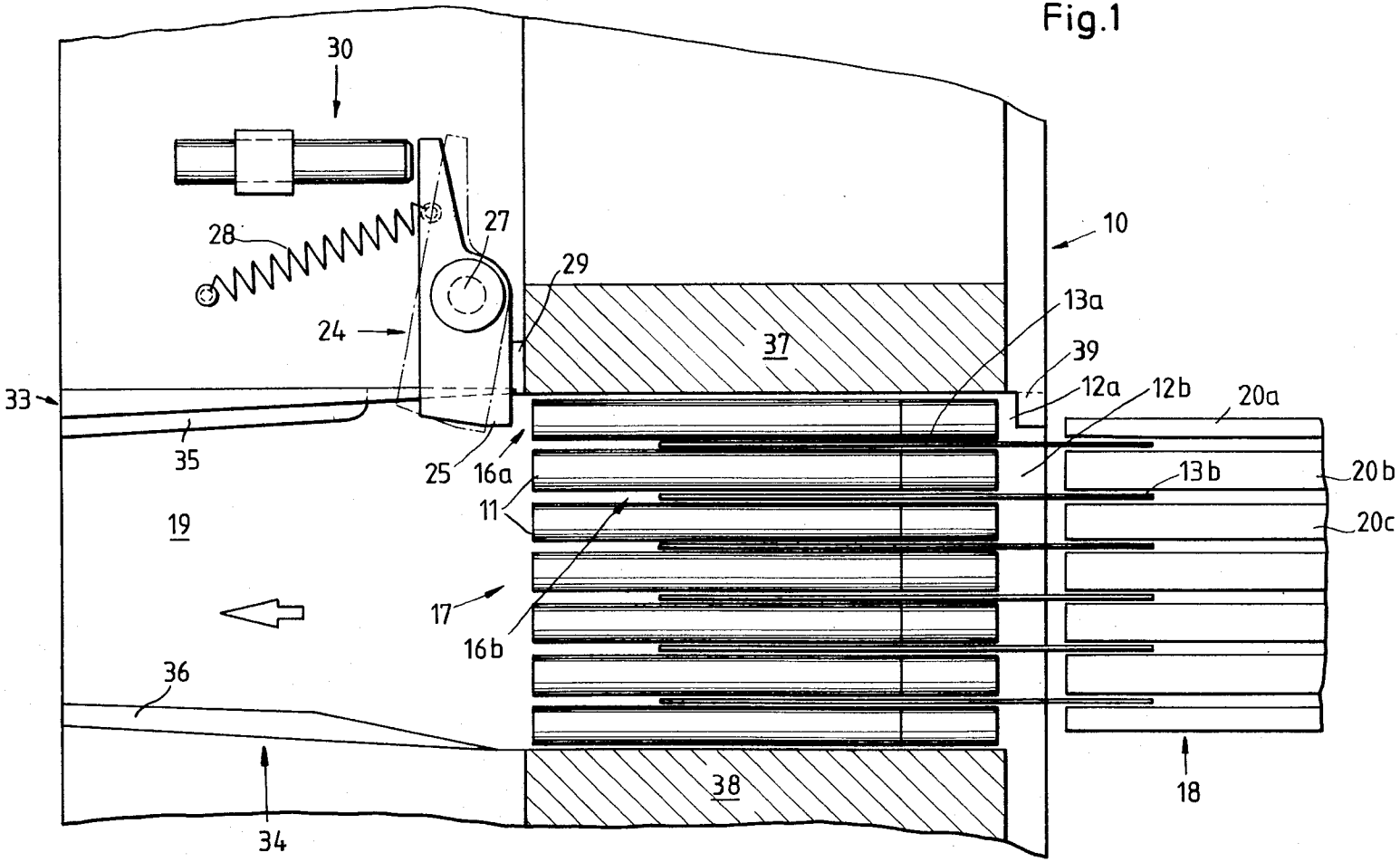
FIG. 1 shows, in horizontal section or plan view, the lower region of a cigarette magazine, in the initial position.
Figure 2:
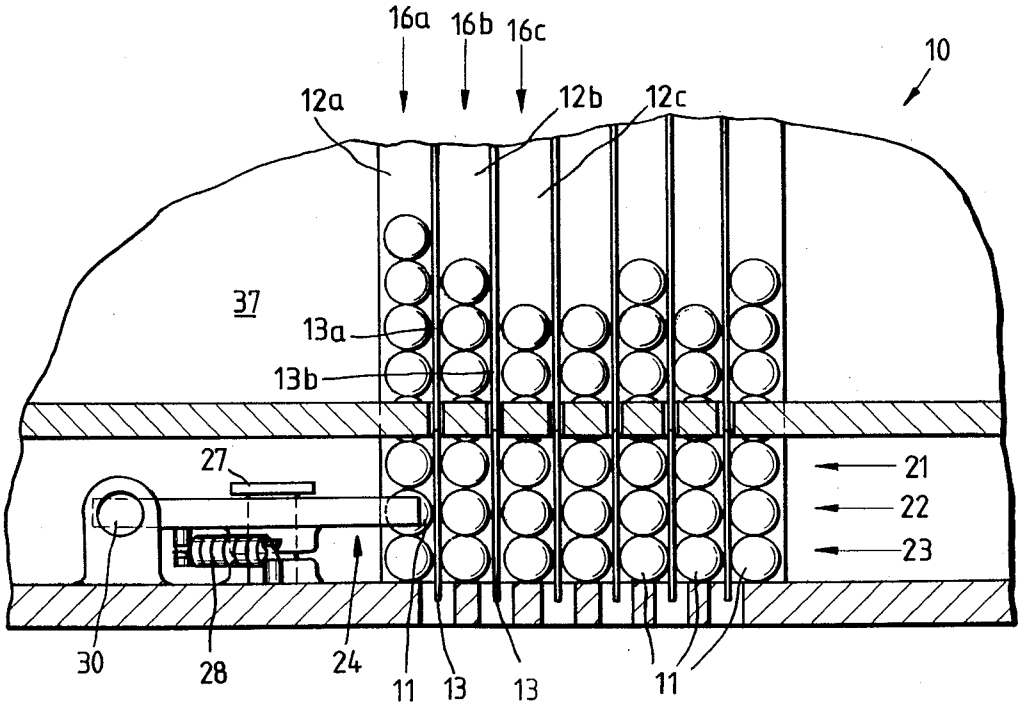
FIG. 2 shows a vertical section, taken transversely to the pushing-out direction, of the detail according to FIG. 1.
Figure 3:
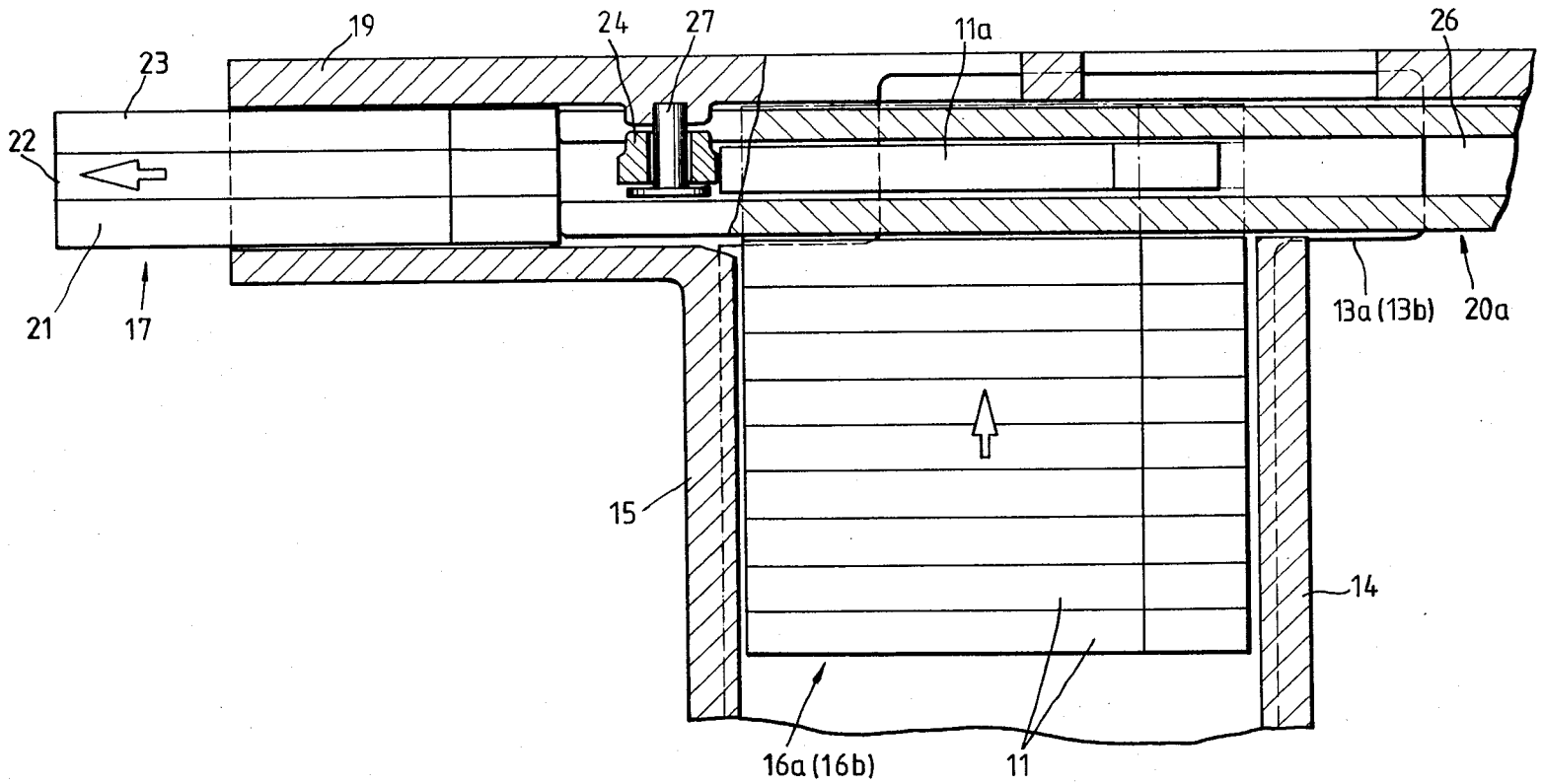
FIG. 3 shows a vertical section of the detail according to FIGS. 1 and 2, offset 90° relative to FIG. 2, that is to say taken in the conveying direction.

The embodiment illustrated in the drawings relates to the design of a cigarette magazine 10. A relatively large number of cigarettes 11 is accommodated in a funnel-shaped container, not shown in detail, which can be designed, for example, as disclosed in German Patent Specification No. 2,428,168. In the lower region of the cigarette magazine 10 a plurality of vertical cigarette shafts 12*a*, 12*b*, etc., is formed. These are limited by likewise vertical shaft walls 13*a*, 13*b*, etc. The thin shaft walls 13*a*, 13*b*, which consist, for example, of spring steel, are anchored in a suitable way in side walls 14 and 15 of the cigarette magazine 10. The cigarette shafts 12*a*, 12*b*, etc., limited in this way have a width which is suitable for receiving one vertical row of cigarettes 16*a*, 16*b*, etc. each. Accordingly, a vertical cigarette row 16*a*, 16*b*, etc., consisting of cigarettes 11 following closely on one another is located in each cigarette shaft 12*a*, 12*b*. As a result of their own weight, these cigarettes are conveyed out of the upper part of the cigarette magazine 10.

In the lower region, namely underneath the appropriately dimensioned side walls 14, 15, cigarette groups 17 are successively ejected by a pushing-out device 18 which is movable to and fro and are introduced into an adjoining discharge conveyor track 19. The cigarette group 17 separated out simultaneously by the pushing-out device 18 corresponds in number and formation of the cigarettes to the contents of a cigarette pack to be produced.

The pushing-out device 18 is equipped, for executing the pushing-out cycle, with a number of tongues 20*a*, 20*b*, etc., corresponding to the number of cigarette shafts 12*a*, 12*b*, etc., to be emptied. Each tongue 20*a*, 20*b*, etc., of rectangular cross-section penetrates into the cigarette shaft 12*a*, 12*b*, etc., assigned to it and grasps on their rear side a number of cigarettes 11 corresponding to the constructional height of the tongue 20*a*, 20*b*, etc. In the present embodiment, three cigarettes lying on top of one another in a cigarette shaft 12*a*, 12*b*, etc., are pushed out with each working cycle of the pushing-out device 18. Accordingly, the cigarette group 17 thus formed consists of three transverse rows 21, 22 and 23 arranged above one another.

The desired formation of the cigarette group 17 makes it necessary for the middle transverse row 22 to have a smaller number of cigarettes 11 than the top and bottom transverse rows 21, 23. In the embodiment shown, a seven/six/seven grouping is produced.

For this purpose, whenever the cigarette group 17 is pushed out, one cigarette 11*a* in the middle transverse row 22 is retained in a cigarette shaft, specifically in the lateral cigarette shaft 12*a*. This reduction in the number of cigarettes 11 pushed out is brought about by a stop 24 fixed in place, but movable, in conjunction with the special design of the pushing-out device 18. The stop 24 is mounted on the outlet side of the cigarette shafts 12*a*, 12*b*, etc. and laterally beside them in such a way that one end of the stop 24, namely a retaining nose 25, projects into the path of movement of the outer cigarette 11*a* in the middle transverse row 22.

The tongue 20*a* assigned to this cigarette shaft 12*a* has a similar design, namely is provided with a longitudinal slot 26 which is located at the height of the cigarette 11*a* and is dimensioned so that the above-mentioned cigarette 11*a* is left untouched during the pushing-out movement. In the course of the pushing-out movement, the stop 24 or its retaining nose 25 also penetrates into the longitudinal slot 26.

During the rapid and frequent pushing-out cycles, disturbances can arise due to the fact that the stop 24 is subjected to a relatively high load. For this reason, the stop 24 is mounted movably, in the present case so as to be pivotable about a pivot bearing 27. Accordingly, the stop 24 is designed as a two-armed lever, one arm of which forms the retaining nose 25 and the other arm of which is loaded in the initial position by means of a restoring spring 28. In this position shown in FIG. 1 by unbroken lines, the stop 24 rests against a shoulder 29 of the cigarette magazine 10.

Figure 4:
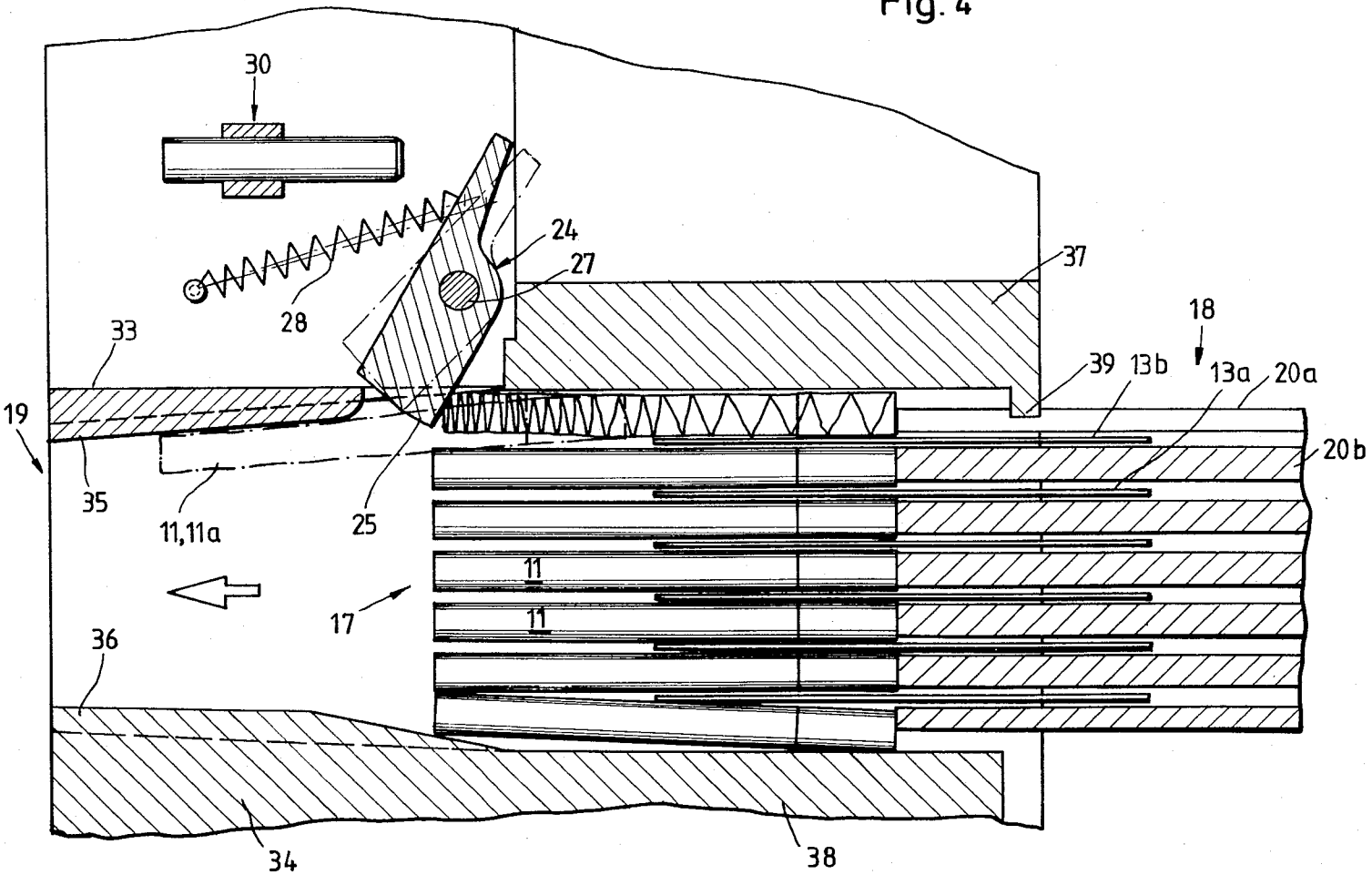
FIG. 4 shows a horizontal section or plan view similar to FIG. 1, with a changed relative position.

As is evident from FIG. 4 (the position shown by dot-and-dash lines), a movement of the stop 24 under appropriate stressing by pivoting, results in the path in the region of the stop 24 being opened. Furthermore, however, because of a movement of the stop 24 caused as a result of a malfunction, a signal is generated, specifically by the actuation of a (non-contact) initiator 30 of known design. As a result of the pivoting movement of the stop 24, the arm facing the initiator 30 moves away from the latter, so that a signal is generated in a known way. In FIG. 1, this first possible position of the stop 24, in which the initiator 30 is actuated, is shown by dot-and-dash lines. Under greater stress, the stop 24 is then moved into the positions shown in FIG. 4, which finally leads to a complete movement out of the path assigned to the cigarette 11*a*.

Figure 5:
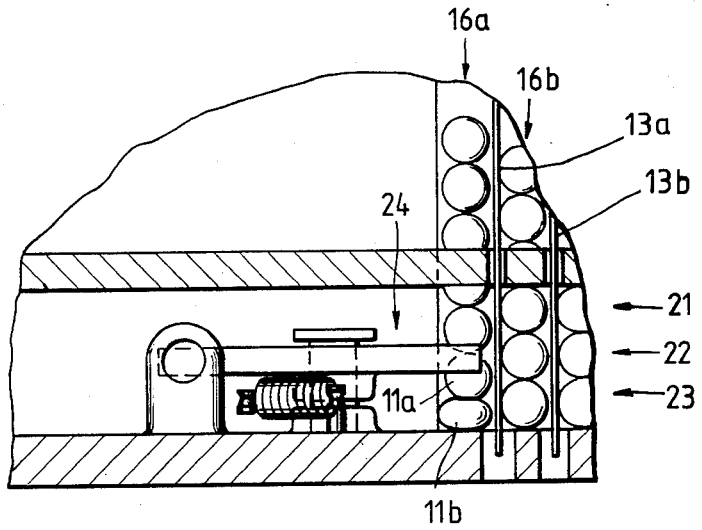
FIG. 5 and FIG. 6 show details of cigarette shafts in vertical section taken transversely to the pushing-out direction, with examples of possible sources of error.
Figure 6:
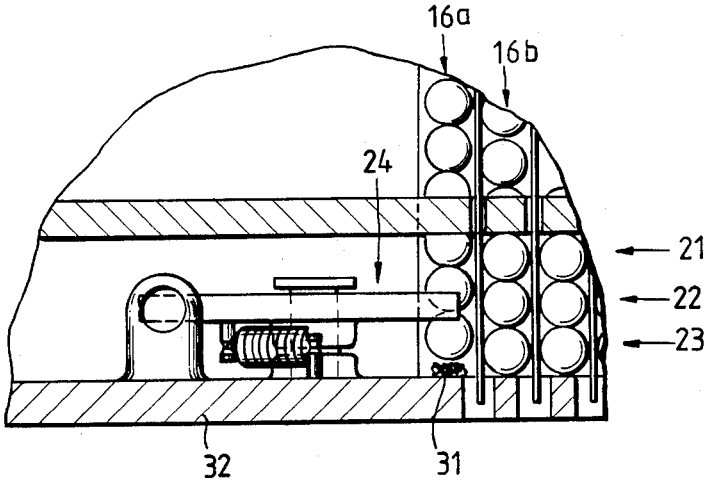

FIGS. 5 and 6 show examples of the causes of malfunctions of this type. In principle, these are based on the fact that the cigarette 11*a* to be retained in the cigarette shaft 12*a* is not located exactly in the region of the stop 24, but is offset vertically relative to the latter. The result of this is that part regions of two cigarettes lie at the height of the stop 24 and these cigarettes are thereby retained by the latter during the pushing-out movement. However, since the associated tongue 20*a* of the pushing-out device 18 is also set at the height of the stop 24 as regards the longitudinal slot 26, in changed relative positions both cigarettes or at least one cigarette located partially in the region of the stop 24 are stressed, namely pushed out. This necessarily leads to the upending shown in FIG. 4, although for the reasons described this cannot lead here to a serious disturbance. The load applied by the (upended) cigarettes to the stop 24 finally becomes so great, during the pushing-out movement, that the stop 24 is pivoted in the way described and is moved back out of the path of movement. The complete group can therefore be pushed out and separated out in a suitable way.

Causes of malfunctions of this type are, for example, mis-shapen, namely flat cigarettes 11*b*, (FIG. 5) of accumulated residues of tobacco 31 (FIG. 6) which form an elevation on a bottom wall 32 of the cigarette shaft 12*a* and thus disturb the proper positioning of the cigarettes.

The discharge conveyor track 19 adjoining the cigarette shafts 12*a*, 12*b*, etc., is provided with special lateral guides 33 and 34. These are made to converge in the conveying direction, so that the cigarettes of a cigarette group 17 are pushed together in a transverse direction, as a result of transport from the discharge conveyor track 19, with the given distances between them being eliminated. Furthermore, the lateral guides 33, 34 are provided, at the level of the middle transverse row 22, with ribs 35, 36 projecting inwards. These cause lateral displacement of the cigarettes in the transverse row 22, in such a way that they assume the desired saddle arrangement.

A further special feature relates to the design of one of the longitudinal walls 37 and 38 of the cigarette magazine 10. The longitudinal wall 37 facing the tongue 20*a* with the longitudinal slot 26 is designed, on the side located opposite the pushing-out side, with a projection 39 which penetrates as a guide member into the longitudinal slot 26 of the tongue 20*a*. The relatively thin parts of the slotted tongue 20*a* are thereby stablised and guided.

We claim:

1. An apparatus for forming pack groups of cigarettes, comprising:

(a) a magazine (10) defining, at a bottom discharge end thereof, a plurality of closely adjacent vertical shafts (12) each accommodating a plurality of horizontally oriented cigarettes (11) singly stacked above one another, (b) horizontally reciprocable pusher means (18) disposed adjacent the bottom end of the magazine and laterally insertable thereinto to simultaneously eject a group of cigarettes from said shafts, said group comprising at least two superimposed layers of cigarettes with a first one of said layers having at least one more cigarette than a second one of said layers, and (c) a stop member (24) mounted adjacent an ejection side of one of the magazine shafts for retaining at least one cigarette (11*a*) of the second layer in the shaft during normal operation of the apparatus, (d) said stop member comprising a pivotably mounted lever (27), one end (25) of the lever extending laterally across an ejection path of said at least one cigarette during normal operation, and a return spring (28) connected to the lever for biasing the lever into an ejection blocking position, the tension of said spring being selected to enable the lever to pivot out of said blocking position in response to a load applied to said one end exceeding a predetermined level to thereby enable the ejection of said at least one cigarette, whereby jamming and blockage due to non-uniform cigarette configurations and non-uniform stacking configurations in the magazine shafts are avoided.

2. An apparatus according to claim 1, further comprising excess load sensing means (20) mounted proximate the lever for generating a control signal in response to the pivotal movement of the lever.

3. Apparatus according to claims 1 or 2, wherein the pusher means comprises a plurality of tongues (20*a*, 20*b*, etc.) each insertable into a magazine shaft (12*a*, 12*b*, etc.), a tongue (20*a*) insertable in said one of the magazine shafts having a continuous central longitudinal slot (26) to prevent said tongue from engaging said at least one cigarette or said stop member.

4. Apparatus according to claim 3 wherein a projection (39) located on a longitudinal wall (37) of the cigarette magazine projects into the longitudinal slot of said tongue to provide guidance and support.

* * * * *